US008662159B2

(12) United States Patent
Xu

(10) Patent No.: US 8,662,159 B2
(45) Date of Patent: Mar. 4, 2014

(54) APPARATUS FOR ISOLATING AND COMPLETING MULTI-ZONE FRAC PACKS

(71) Applicant: Richard Yingqing Xu, Tomball, TX (US)

(72) Inventor: Richard Yingqing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/735,681

(22) Filed: Jan. 7, 2013

(65) Prior Publication Data

US 2013/0126151 A1 May 23, 2013

Related U.S. Application Data

(62) Division of application No. 12/634,577, filed on Dec. 9, 2009, now Pat. No. 8,371,370.

(51) Int. Cl.
*E21B 43/04* (2006.01)
*E21B 33/13* (2006.01)

(52) U.S. Cl.
USPC ..... 166/51; 166/278; 166/285; 166/191

(58) Field of Classification Search
USPC ..... 166/278, 51, 285, 169, 191
See application file for complete search history.

(56) References Cited

U.S. PATENT DOCUMENTS 3,083,765 A 4/1963 Kammerer
3,474,866 A 10/1969 Dellinger et al.
4,034,811 A 7/1977 Sparlin et al.
4,797,159 A 1/1989 Spangle
5,090,478 A * 2/1992 Summers ..... 166/278
5,184,677 A 2/1993 Dobscha
5,211,234 A * 5/1993 Floyd ..... 166/276
5,375,661 A 12/1994 Daneshy et al.
5,392,850 A 2/1995 Cornette et al.
5,484,020 A 1/1996 Cowan
5,697,441 A * 12/1997 Vercaemer et al. ..... 166/285
5,942,031 A 8/1999 Cheung
5,988,276 A 11/1999 Oneal
6,009,951 A 1/2000 Coronado et al.
6,298,919 B1 10/2001 Browne et al.
6,318,465 B1 * 11/2001 Coon et al. ..... 166/278
6,513,600 B2 2/2003 Ross
6,766,858 B2 * 7/2004 Nguyen et al. ..... 166/300
6,779,600 B2 * 8/2004 King et al. ..... 166/120
6,782,946 B2 8/2004 Perkins et al.
7,559,375 B2 * 7/2009 Dybevik et al. ..... 166/316
7,934,555 B2 * 5/2011 Morton ..... 166/278
2008/0164026 A1 7/2008 Johnson

* cited by examiner

*Primary Examiner* — William P Neuder
*Assistant Examiner* — Robert E Fuller
(74) *Attorney, Agent, or Firm* — Steve Rosenblatt

(57) ABSTRACT

A completion assembly for subterranean use from a surface in multiple zones that are gravel packed together has a plurality of screens spaced apart with tubulars that define an annulus around them in the subterranean location for receipt of gravel in the annulus. The annulus spans multiple zones and the annulus is isolated from the surface by at least one packer. At least one barrier forming chemical is delivered from the tubulars into the annulus that has been gravel packed. The barrier chemical forms a barrier with the gravel in the annulus between at least two zones. The tubulars comprise at least one opening located between zones. A straddle tool is insertable from the surface into said tubulars to isolate the opening for chemical delivery into the annulus.

5 Claims, 3 Drawing Sheets

APPARATUS FOR ISOLATING AND COMPLETING MULTI-ZONE FRAC PACKS

PRIORITY INFORMATION

The application is a divisional of U.S. patent application Ser. No. 12/634,577 filed on Dec. 9, 2009.

FIELD OF THE INVENTION

The field of this invention is well completions and more particularly completions that allow multi-zone completions that call for fracturing, gravel packing and isolation in a single trip.

BACKGROUND OF THE INVENTION

In the past in the case of a broad pay zone or multi pay zone to be completed the procedure was to break it into sections. The fracturing and gravel packing equipment is run into cased and perforated hole along with an isolation packer. The packer would be set to isolate the lowermost zone and the isolated zone would then be fractured below that packer. Thereafter, gravel would be delivered outside screens through a crossover to fill the annular space around the screen with gravel. After that the packer would remain in the zone just gravel packed along with the screens with gravel on their exterior as the crossover and associated wash pipe were pulled out through the already set packer. After that zone was isolated, fractured, and gravel packed another trip in the hole with a similar assembly as used for the lowest zone would be run in for doing the same for the next zone up. This process continued until all zones or sections of a continuous zone were completed.

This technique required many trips in and out of the wellbore and that translated into very high expenses for rig time. One of the reasons that this staged procedure was used was that to do it another way where an entire interval could be isolated and fractured and gravel packed at once required packers to then be set in the annulus after gravel packing. The packers that had been available were not known for reliable sealing against the inside wall of casing if the annular space was full of gravel.

More recently packer designs have evolved and sealing in an annulus that is full of gravel is possible. An example of such a packer is U.S. Pat. No. 6,896,049. Other packer designs are illustrated in U.S. Pat. Nos. 6,782,946; 5,988,276; 6,009,951; 7,100,690; 5,184,677 and 6,513,600.

Packers that push gravel out of the way for a metal to metal seal in cased hole have been suggested in a multi-zone completion method described in US Publication 2008/0164026. The issue with the metal to metal seal packers is the high force required to push the gravel aside while a complex crossover is still in the hole.

The present invention seeks to build on the technique of multiple zone fracturing and gravel packing by creating a barrier between producing zones that are gravel packed together by injecting fluid into the gravel packed annulus that forms a barrier between or among the zones. The injected material is a sealing material that is known in the art and some examples are discussed in U.S. Pat. Nos. 5,942,031 and 4,797,159. In the preferred embodiment the material is placed in the same trip as the gravel packing and the wash pipe with a shifting tool integrated into it is used to inject the chemical into the desired locations between zones to create barriers. The chemical can be stored inside the outer assembly and the shifter associated with the wash pipe can sequentially evacuate the chambers with the chemical into the annular space to create a barrier or barriers as required. These and other features of the present invention will be more readily apparent to those skilled in the art from a review of the detailed description of the preferred embodiment and the associated drawings with the understanding that the full scope of the invention is determined by the appended claims.

SUMMARY OF THE INVENTION

A plurality of zones is gravel packed together and then isolated from each other in the gravel annulus by formation of a barrier in the gravel annulus. The screen assembly carries a series of chambers internally that are located between the producing zones generally in the area of blank pipe between the zones. The wash pipe has a shifter associated with it so that extraction of the wash pipe after gravel packing will serially shift pistons that reduce chamber volume where the chemical is stored. The chemical will exit through a rupture disc and nozzle and will commingle with the gravel and make an impervious annular barrier.

DETAILED DESCRIPTION OF THE PREFERRED EMBODIMENT

Figure 1:
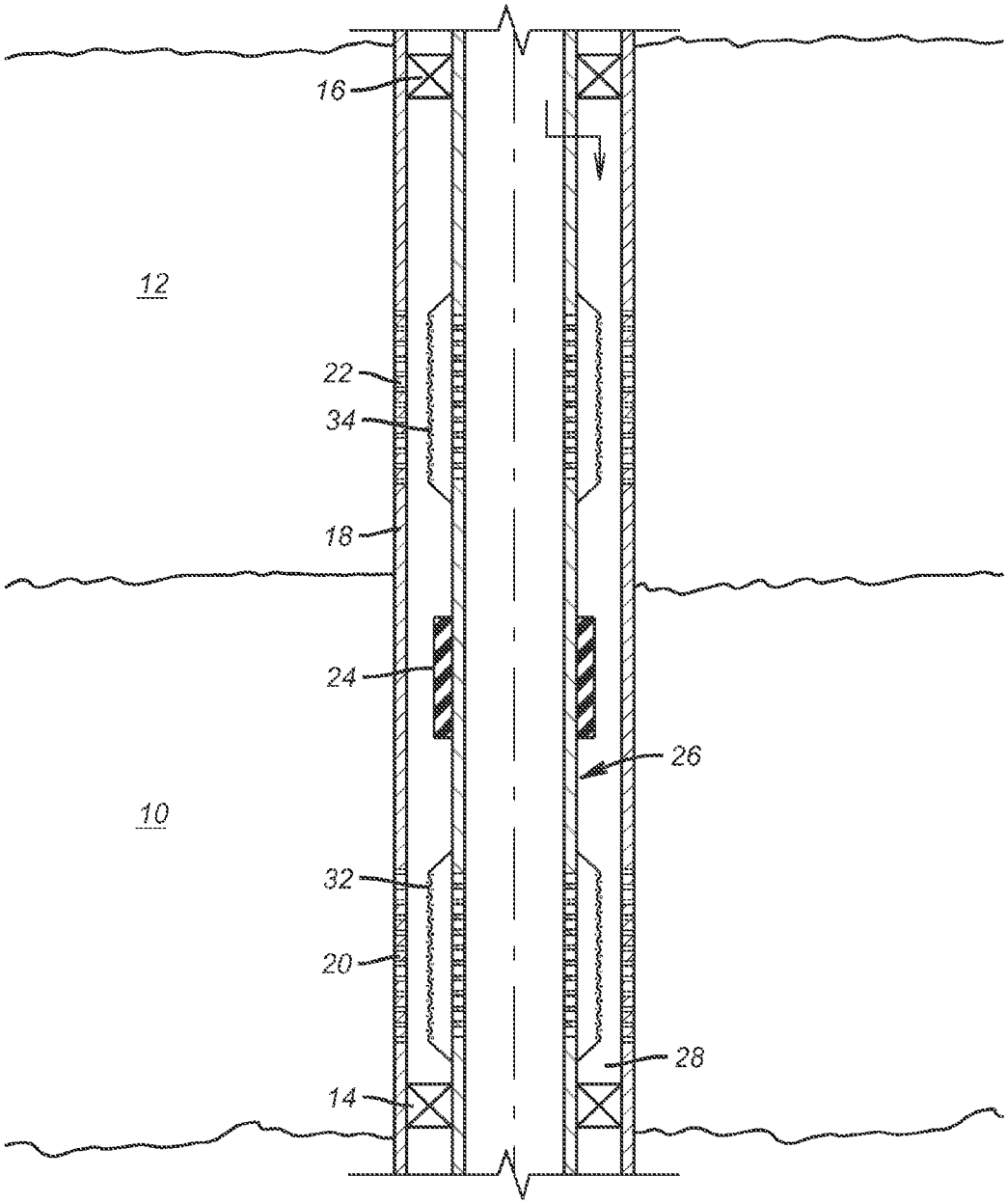
FIG. 1 is a section view of multiple zones before gravel packing showing the chemical barrier between the zones.
Figure 2:
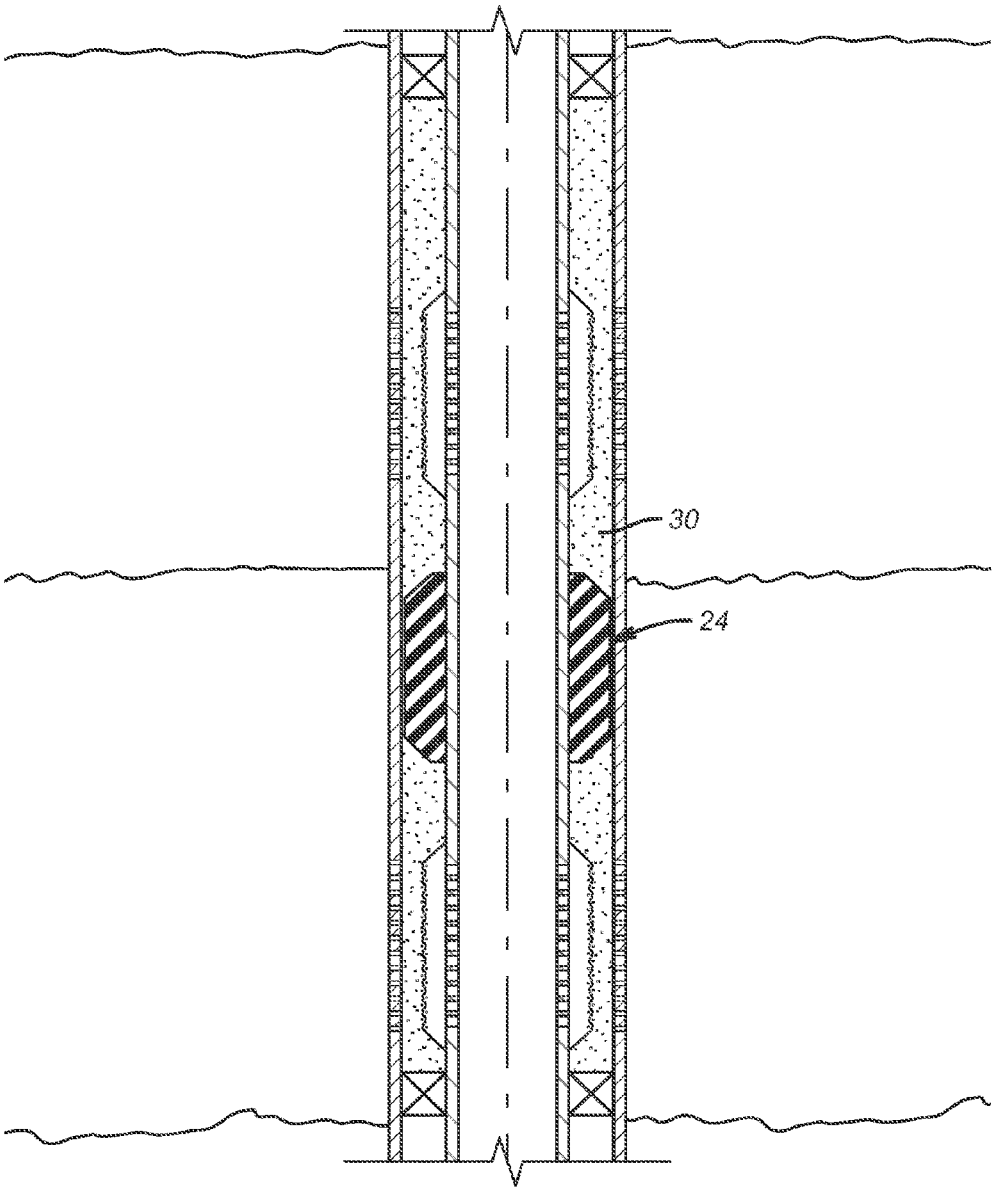
FIG. 2 is the view of FIG. 1 after gravel packing and the barrier formed between zones.
Figure 3:
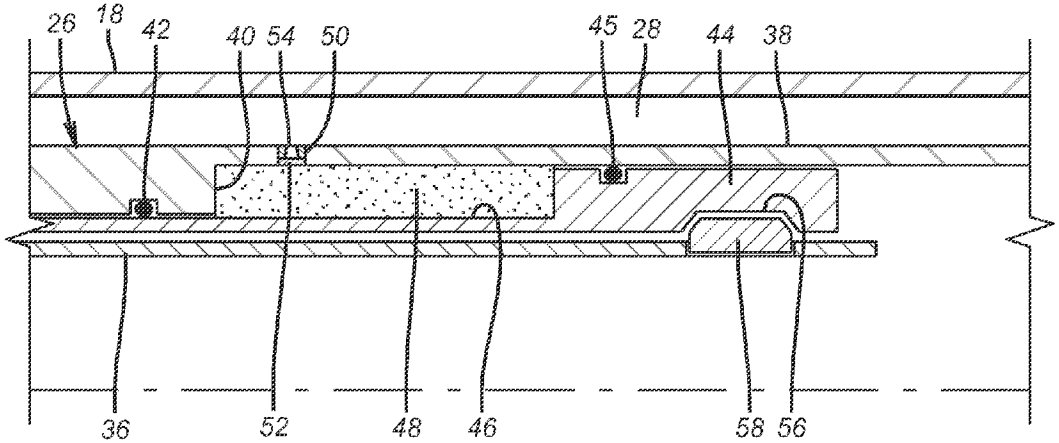
FIG. 3 is a detailed view of a delivery system for the chemical that makes the annular barrier in the gravel showing it actuated by wash pipe removal.

FIG. 1 illustrates producing zones 10 and 12 that are isolated by a bottom packer 14 and a top packer 16 set in casing 18. Casing 18 has perforations 20 into zone 10 and 22 into zone 12. A barrier assembly 24 is schematically illustrated on the outer completion string 26 but can actually be located internally to string 26 as shown in FIG. 3. Annulus 28 is between string 26 and casing 18 and will be filled with gravel slurry 30 as shown in FIG. 2. The barrier assembly 24 is not actuated until the gravel pack for both zones 10 and 12 is complete. While two zones are shown for illustrative purposes, those skilled in the art will appreciate that additional zones can be gravel packed or fractured together before being isolated from each other for production. The manner of depositing the gravel is known in the art using crossover tools that comprise an outer completion that is illustrated as 26 with screens 32 and 34. The crossover tool and the wash pipe that comprises the inner string are not shown in FIGS. 1 and 2 for clarity but in the detailed view of FIG. 3 the wash pipe 36 that is shifted within the outer completion 26 can be seen. FIG. 3 illustrates how the wash pipe 36 interacts with the outer completion 26 to create one or more barriers in the annulus 28 after it is gravel packed. FIG. 2 illustrates one of potentially several annulus barriers 24 that are created in the gravel pack 30 to isolate zones such as 10 and 12.

The chemical composition of the material that creates the barriers 24 is also known in the art; however, it is its application into the system described that is part of the claimed invention. The barriers created substantially isolate adjacent zones 10 and 12 in the annulus 28 and as an option can also be fully impervious barriers.

One way to discharge the seal material to make a barrier 24 is shown in FIG. 3. The outer completion string 26 has sections of blank pipe 38 with an internal shoulder 40 and a seal 42. A piston 44 with a seal 45 is located within blank pipe 38 so that a variable volume cavity 46 is defined between the piston 44 and the pipe 38. The cavity 46 is filled with the sealing material 48 of a type known in the art that will form a barrier when delivered into the annular space 28. An opening 50 extends from the cavity 46 through the pipe 38. The opening 50 is initially closed by a rupture disc 52 located ahead of an optional nozzle 54. While one such assembly for an outlet from cavity 46 is shown there can also be multiple outlets that are circumferentially spaced and disposed in a single or multiple rows so as to enhance the creation of a barrier seal 24. The piston 44 has a recess 56 that is selectively engaged by the wash pipe 36 that supports a shifting tool 58 that is schematically illustrated. This tool is capable of engaging the recess 56 and shifting piston 44 followed by a release of recess 56 as the wash pipe 36 continues uphole after the gravel pack crossover is removed so that production can start when the packer 16 is tagged with a production string (not shown). As the wash pipe 36 moves further uphole it can engage other recesses similar to 56 in other pistons 44 further uphole so that multiple barriers 24 are formed in the gravel pack 30 in the annulus 28.

Figure 4:
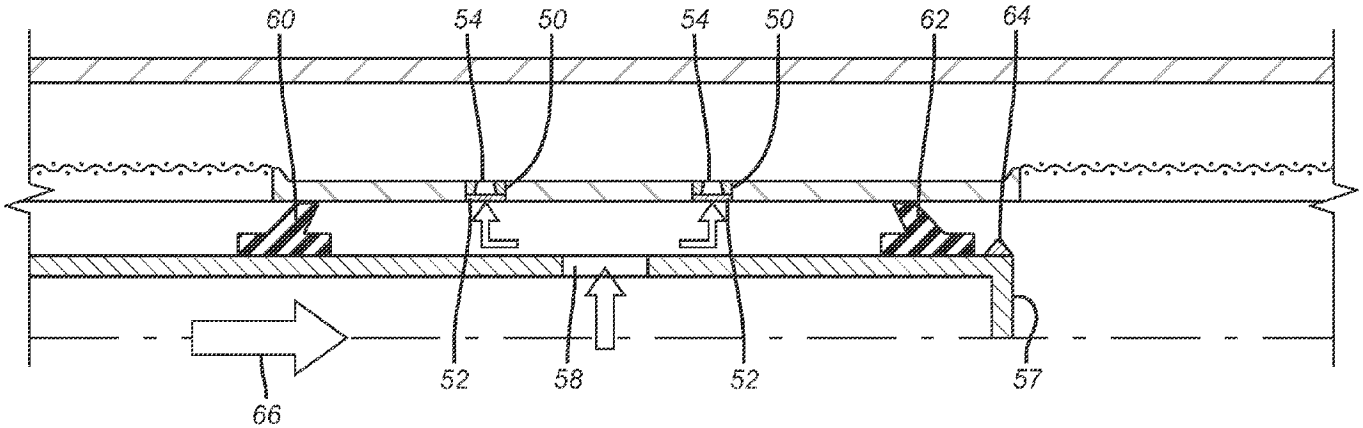
FIG. 4 is an alternative embodiment for creating barriers in the gravel pack.

An alternative way to create barriers at discrete locations would be to expose openings 50 in the blank pipe sections 38 and then pull out the wash pipe 36 and run in with a straddle tool to straddle each opening 50 and pump the barrier chemical from the surface through the various ports 50. Doing so does add another trip into the well with the straddle tool and further requires proper placement of the tool and delivery of a predetermined volume of the barrier chemical to the site. FIG. 4 illustrates this approach. The tool 57 is run in after the wash pipe 36 is pulled out from the outer completion 26. It has an opening 58 and spaced cup seals 60 and 62 that straddle it. The cup seals 60 and 62 are positioned to straddle opening 50 that in this embodiment can also have a rupture disc 52 and a distribution nozzle 54. There can be more than one opening 50 that is straddled by cup seals 60 and 62. A locating feature 64 such as a dog is schematically illustrated to aid in proper placement of the tool 57 in various locating grooves or other features (not shown) associated with locations of openings 50. Arrow 66 represents the chemical flow from the surface through the tool 57 and out through openings 50 disposed between the cup seals 60 and 62. The required volume can be spotted in the tool 57 near opening 58 with a wiper plug behind it to avoid filling a string with more of the chemical than needed to create the desired barriers in the gravel 30 at the desired locations.

The above description is illustrative of the preferred embodiment and many modifications may be made by those skilled in the art without departing from the invention whose scope is to be determined from the literal and equivalent scope of the claims below.

I claim:

1. A completion assembly for use in a subterranean location having multiple producing zones that are gravel packed together, comprising:

a plurality of open screens spaced apart with blank tubulars that define a gravel packed annulus around them in the subterranean location, said annulus spanning multiple producing zones and said annulus is isolated from the surface by at least one packer;

said blank tubulars comprise at least one opening located between said zones, said opening initially closed by a temporary closure;

a straddle tool selectively insertable from the surface into said completion assembly, said straddle tool positioned between said screens and isolating said at least one opening, said straddle tool delivering a barrier forming chemical into said gravel packed annulus through said opening, thereby opening said temporary closure by pressure of said delivery;

said barrier forming chemical forming a barrier with said gravel in said gravel packed annulus between at least two zones, said screens remaining open after delivery of said barrier forming chemical.

2. The assembly of claim 1, wherein:

said temporary closure is a rupture disc.

3. The assembly of claim 1, wherein:

said opening further comprises a nozzle.

4. The assembly of claim 1, wherein:

said straddle tool comprises opposed and spaced apart cup seals.

5. The assembly of claim 4, wherein:

said at least one opening comprises a plurality of axially spaced openings each having a location feature;

said straddle tool contacting said location feature for positioning said cup seals sequentially at said openings for creating a plurality of zone barriers in the gravel in the annulus.

* * * * *